US005868920A

United States Patent [19]

Nylund et al.

[11] Patent Number: 5,868,920

[45] Date of Patent: Feb. 9, 1999

[54] METHOD FOR INHIBITION OF GROWTH OF ORGANISMS ON FACES OF CONSTRUCTIONS SUBMERGED IN A LIQUID

[75] Inventors: Ari Nylund, Espoo; Martti Pulliainen, Anttola; Jyrki Peltonen, Helsinki; Timo Laurila, Tampere; Miki Turkia, Espoo, all of Finland

[73] Assignee: Synton Oy, Vantaa, Finland

[21] Appl. No.: 836,604

[22] PCT Filed: Nov. 1, 1995

[86] PCT No.: PCT/FI95/00602

§ 371 Date: Nov. 24, 1997

§ 102(e) Date: Nov. 24, 1997

[87] PCT Pub. No.: WO96/13425

PCT Pub. Date: May 9, 1996

[30] Foreign Application Priority Data

Nov. 1, 1994 [FI] Finland ..... 945142

[51] Int. Cl.[6] ..... C23F 13/00

[52] U.S. Cl. ..... 205/728; 205/724; 205/726; 205/727; 205/729; 205/735; 205/740; 205/741

[58] Field of Search ..... 205/728, 724, 205/735, 736, 738, 740, 741, 729, 726, 727; 204/196, 197

[56] References Cited

U.S. PATENT DOCUMENTS

| | | | |
|---|---|---|---|
| 3,412,005 | 11/1968 | Beer et al. | 204/196 |
| 3,497,434 | 2/1970 | Littauer | 204/147 |
| 3,661,742 | 5/1972 | Osborn et al. | 204/147 |
| 5,009,757 | 4/1991 | Riffe et al. | 204/147 |
| 5,344,531 | 9/1994 | Saito et al. | 204/147 |

FOREIGN PATENT DOCUMENTS

| | | |
|---|---|---|
| 0145802 | 12/1983 | European Pat. Off. . |
| 0369557 | 5/1990 | European Pat. Off. . |
| 0468739 | 7/1991 | European Pat. Off. . |
| 2035144 | 1/1971 | Germany . |
| 1597305 | 5/1978 | United Kingdom . |
| 2118972 | 11/1983 | United Kingdom . |
| 2207912 | 2/1989 | United Kingdom . |
| 8703261 | 6/1987 | WIPO . |
| 9013474 | 11/1990 | WIPO . |

*Primary Examiner*—Bruce F. Bell
*Attorney, Agent, or Firm*—Steinberg & Raskin,P.C.

[57] ABSTRACT

The invention concerns a method for inhibition of growth of organisms on faces of constructions (11) submerged in a liquid. In themethod, an electrically conductive structure (11) to be protected is connected as the cathode of a source (14) of direct current, or an electrically non-conductive structure (111) to be protected is first coated with an electrically conductive material **(111*a*) and connected as the cathode of a source of direct current (14), respectively, and, as the anode (12), an anode is used that has been isolated from the structure (11) to be protected or that is placed separate from said structure, which anode is connected as the anode of the source (14) of direct current. A control signal is given to the source (14) of direct current from a control unit (15), which control signal changes the current density and/or the voltage supplied by the source (14) of direct current, whereby the pH of the liquid on the face of the structure (11) to be protected varies with such of a frequency that the microbial organisms on the face of the structure (11)** to be protected cannot adapt themselves to the changing conditions.

14 Claims, 2 Drawing Sheets

METHOD FOR INHIBITION OF GROWTH OF ORGANISMS ON FACES OF CONSTRUCTIONS SUBMERGED IN A LIQUID

This application is a 371 of PCT/FI95/00602 filed on Nov. 1, 1995.

BACKGROUND OF THE INVENTION

The invention concerns a method for inhibition of growth of organisms on faces of constructions submerged in a liquid, in which method an electrically conductive structure to be protected is connected as the cathode of a source of direct current, or an electrically non-conductive structure to be protected is first coated with an electrically conductive material and connected as the cathode of a source of direct current, respectively, and, as the anode, an anode is used that has been isolated from the structure to be protected or that is placed separate from said structure, which anode is connected as the anode of the source of direct current.

The phenomenon of fouling means covering of faces in contact with water with colonies formed by organisms adhering to said faces. Fouling is produced both by micro-organisms and by plants and animals. Fouling usually starts with adhering and spreading of populations of bacteria over faces that are in contact with water. The bacteria pioneers are followed by numerous different algae and other organisms with genuine nuclei, such as barnacles and polyps.

The fouling phenomenon is perhaps most harmful to waterborne traffic (the fuel consumption may increase by up to 40 percent), to industrial plants and power stations that use seawater, and to fish breeding plants.

In the waters of Finland, the fouling trouble was little in the past years. Eutrophication of the water areas near the coasts of the Baltic Sea and an increase in the salt content have increased the disadvantages caused by fouling, in particular in the case of industrial plants that use seawater.

The biggest problems caused by fouling occur in areas in which the salt content in seawater is higher than 5 per mil. In a warm area of seawater which contains salt, fouling is a serious problem for all structures present in the seawater and for all industrial plants and power stations that use seawater as well as for fishing industry. For example, the numerous population in Asia lives mainly on seafood. Ships cannot leave the ports before mechanical cleaning of propellers and other control devices has been carried out.

In order to prevent drawbacks of fouling, at present mainly so-called anti-fouling paint is used. From the anti-fouling paint, one or several substances toxic to the organisms adhering to the structures are separated, such as, for example, copper and tin compounds. In addition to the toxic agents, the smooth face of the paint makes the adhering of the organisms more difficult. However, the anti-fouling paint must be renewed, on the average, at intervals of two years. Organic tin compounds are efficient in combatting the fouling organisms on underwater structures, but they are also toxic for other groups of organisms, such as fish and mammals. Moreover, TBT (tributyl tin) is a poison that accumulates in organisms to a great extent.

Plants and animals can accumulate copper present in dissolved form to a certain extent. Accumulation of copper in the food chain is not known at present, but if high concentrations of dissolved copper are present in water, it may be dangerous to the organisms in the water.

With respect to the prior art, reference is made to the Patent GB-2,118,972, in which the anti-fouling effect described is based on sacrificial Cu/Al or Fe rods. In this prior-art method, Cu/Al or Fe rods are dissolved by means of direct current, and the system of seawater pipes or equivalent that constitutes the structure operates as the cathode. For example, the copper-aluminum hydroxide that is formed prevents formation of growth.

In the method described in the publication EP-0,145,802, the anti-fouling effect is produced by means of sacrificial metal plates, most commonly by means of Cu plates. In this method, the structures to be protected are coated with an insulating layer, onto which a metal plate of a certain size is attached, the size depending on the length of the ship. The protection against corrosion of the structures is effected by supplying a DC-voltage to the hull while graphite, cast iron, platinum-coated titanium, or a Pb/Ag-alloy operates as the anode. The source of DC-voltage consists of a potentiostat, which automatically maintains the potential of the structure to be protected at the pre-set protection potential. The copper hydroxide that is dissolved prevents formation of growth.

In the method described in the publication U.S. Pat. No. 5,009,757, a particular inner Ti electrode and a source of current are employed, and a high capacitance is produced between a zinc coating and the seawater. The zinc-painted hull of the ship operates as the negative terminal of the capacitor. The anti-fouling effect is based on the Helmholtz double layer produced by the electric current between the zinc coating and the seawater.

The anti-fouling effect described in the Pat. Appl. FI-915300 is based on ultrasound. The low-frequency oscillations of the sources of ultrasound make the micro-organisms to be separated from the face of the structure.

In the publication EP-0,468,739, a direct-current method is described, in which an electric shock is given to the microbes growing on the faces to be protected by means of an electric field produced between separate electrodes. In this method, the structure to be protected is not connected to the source of current, but the electric current is passed through a separate displaceable anode to a separate displaceable cathode.

In the publication EP-0,369,557, a direct-current method is described, in which the structure to be protected is coated with a conductive layer, on whose face, in an electrolysis of seawater, an anode reaction forms hypochlorite which kills microbes.

In the publication WO-87/03261, a method based on the use of alternating current is described. In this method, the organisms are destroyed by means of an electric shock produced by means of the field of alternating current. The effect can be intensified by dissolving copper, aluminum and by electrolyzing seawater by means of direct current, in which connection the chlorine gas that is formed kills microbes.

The prior-art methods involve a number of drawbacks. When anti-fouling paints are used, damage to the environment constitutes the major drawback. Also, the annual cost of maintenance becomes relatively high. Moreover, the anodes that are consumed on dissolution of copper, aluminum and iron cause a need of maintenance.

In the ultrasound method, the most important drawbacks are the high cost of the method and the detrimental effects of resonance.

The prior-art electrical methods also involve a number of significant drawbacks. In cases in which the object to be protected is subjected to an external electric field (direct or alternating current), separate electrodes that supply current are needed. Also, in these prior-art methods, a control system that optimizes the current is missing. An excessively high current density produces the risk of hydrogen brittleness in electrically conductive structures. Oxidation, i.e. wear, of a paint that operates as an anode is a clear drawback.

In a method that makes use of the Helmholtz double layer, precipitation of calcium and magnesium on the face and, consequently, formation of a face favourable for growth, is the most important drawback.

SUMMARY OF THE INVENTION

The object of the present invention is to provide an improvement over the prior-art methods and to avoid the numerous drawbacks present in the prior-art methods. It is a more specific object of the invention to provide a method that is suitable for prevention of growth of organisms on the faces of electrically conductive structures and so also of electrically non-conductive structures submerged in a liquid.

The objectives of the invention are achieved by means of a method, which is characterized in that a control signal is given to the source of direct current from a control unit, which control signal changes the current density and/or the voltage supplied by the source of direct current, whereby the pH of the liquid on the face of the structure to be protected varies with such a frequency that the microbial organisms on the face of the structure to be protected cannot adapt themselves to the changing conditions.

In the method in accordance with the present invention, it has been realized to change the current density under control, in which case the pH on the face of the structure varies with such a frequency that the microbial organisms present on the faces of the structures cannot adapt themselves to the changing conditions by means of mutations or by means of changes in the cell wall. In the method of the present invention, a so-called pH-pumping by varying the cathode reaction prevents adaptation of the bacteria to the changing conditions. A rapid increase in pH kills bacteria, and variations in pH also contribute to prevention of the formation of a cathodic precipitate. As a consequence of the cathode reaction, the concentration of hydroxide ions on the face of the coated structure increases to such an extent that the microbes die. As a result of this, strains of organisms that have adapted themselves to living in different oxygen concentrations die when the oxygen concentration changes.

In the method of the invention, the face of an electrically conductive structure submerged in water is coated with a paint that is porous in a controlled way, while the porosity is such that the ions necessary for closing the current circuit can pass through the paint to such an extent that a cathode reaction takes place. The structure to be protected is connected as the cathode of the source of direct current, and as the anode, anodes are used that have been isolated from the structure or that are separate from the structure, and the supply of current to the structure to be protected is controlled by means of separate reference electrodes isolated from the structure, by means of which reference electrodes an excessive supply of current to the structure to be protected is prevented by monitoring its electrochemical potential. The electrochemical properties of such a paint face that is porous in a controlled way are such that precipitation of anions on the face is impossible.

The method in accordance with the invention can be applied to electrically conductive structures submerged in a liquid, such as, for example, steel and aluminum ships and boats, off-shore constructions, supports, and columns of steel, sluice and gate equipments and structures for various water ducts, various process actuators placed in a water circulation, such as, for example, heat exchangers and tanks. The invention is also suitable for use in electrically non-conductive structures submerged in a liquid, such as, for example, wooden boats, pier and support constructions of wood or concrete, structures made of polymer composites, such as, for example, boats, cooling ducts etc. water ducts made of concrete.

The invention will be described in detail with reference to some preferred embodiments of the invention illustrated in the figures in the accompanying drawings, the invention being, however, not supposed to be confined to said embodiments alone.

DETAILED DESCRIPTION OF THE INVENTION

Figure 1:
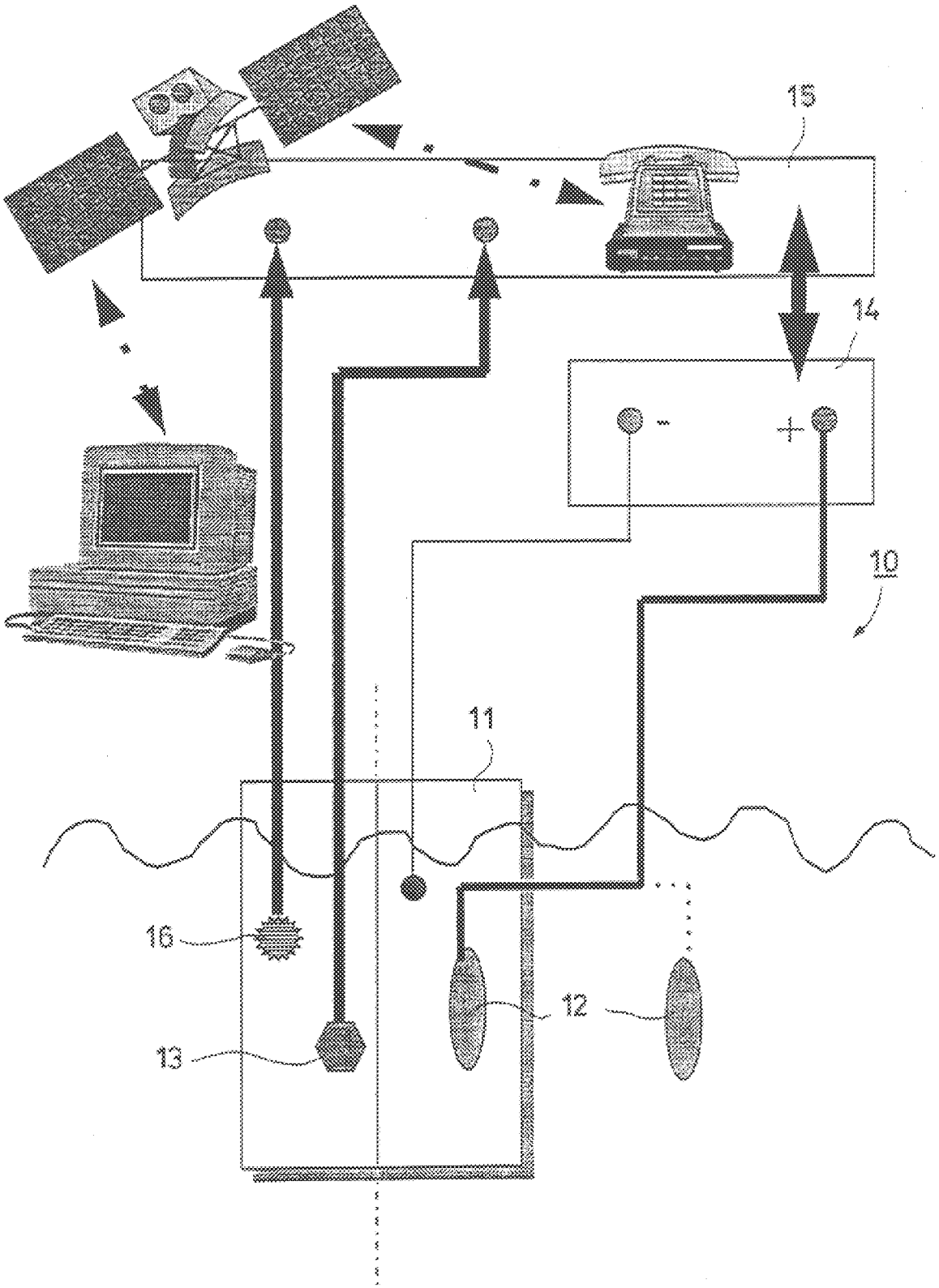
FIG. 1 is a schematic illustration of an equipment for use in the method in accordance with the invention for inhibition of growth of organisms on faces of electrically conductive constructions submerged in a liquid.

In FIG. 1, the equipment in accordance with the invention is denoted generally with the reference numeral 10. The equipment 10 includes a cathode 11, which is an electrically conductive structure, an anode 12, a reference electrode 13 isolated from the structure 11, a source 14 of direct current, and a control logic, i.e. a control unit 15. The anode 12 may be an anode isolated from the structure 11 to be protected, or an anode separate from said structure, as is indicated by the dotted line. Further, the equipment 10 may be provided with a bio-organism detector 16, which informs on any bio-organisms that may be placed on the face of the structure to be protected.

Figure 2:
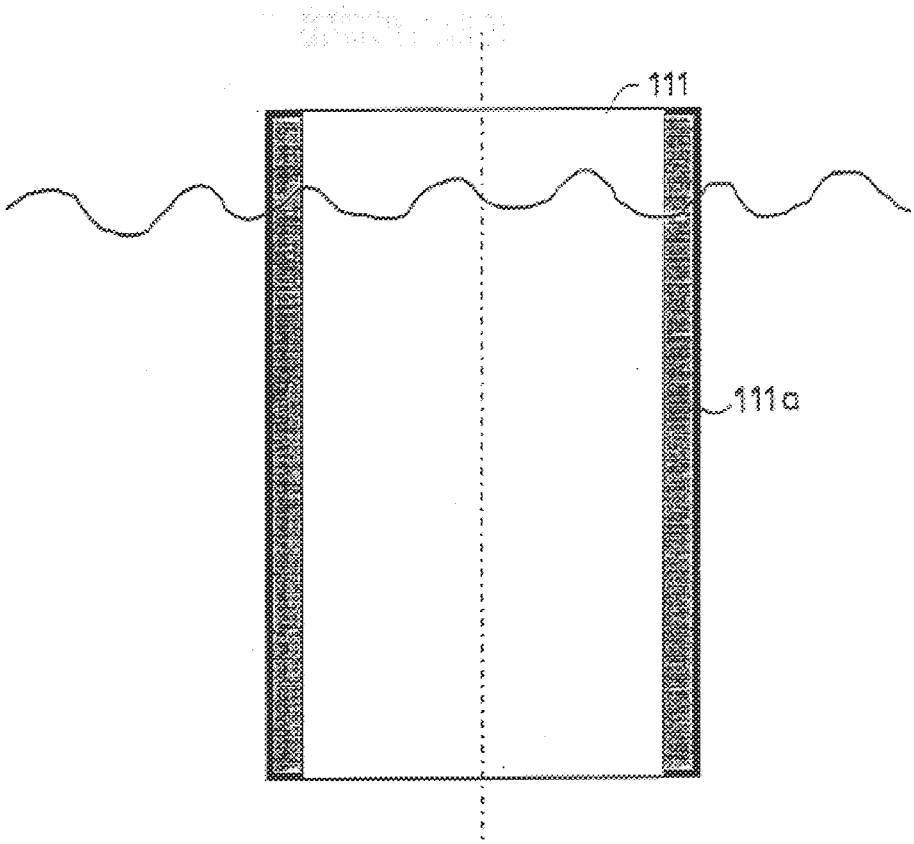
FIG. 2 is a schematic illustration of an electrically non-conductive structure which has been made electrically conductive.

In FIG. 2, an electrically non-conductive structure is denoted with the reference numeral 111. The structure 111 to be protected is coated with a paint 111*a*, which operates as the cathode.

Figure 3:
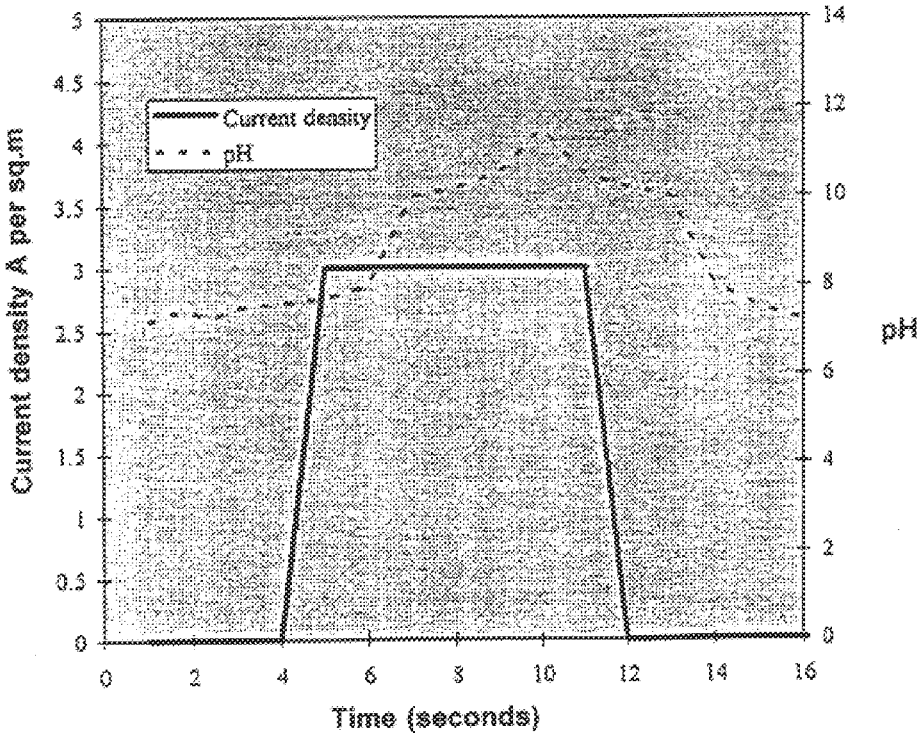
FIG. 3 is a graphic illustration of the effect of a change in the current density on the pH-value.

From FIG. 3 it is seen that a change in the current density, i.e. an increase in the current density has a raising effect on the pH-value. The control unit 15 gives the source 14 of direct current a control signal that changes the current density, whereby the current density may change regularly or randomly. The time interval of the change in current density depends on the structure 11,111 to be protected, and it can be of an order of, for example, one second to 24 hours or several days. From FIG. 3 it is seen clearly that, when the current density becomes higher, the cathode reaction becomes more intensive, as a result of which the pH becomes higher and the oxygen content becomes lower. These changes prevent growth of organisms on the faces of the structure 11,111 to be protected highly efficiently.

When the method of the present invention is used for seawater applications, the maximal value of current density is, as a rule, of an order of 2.5 A per sq.m, and/or the maximal value of the voltage is of an order of 1 V . . . 100 V, whereas, in industrial processes, the intensity may be, for example, of an order of 10 A per sq.m, and/or the maximal value of the voltage is of an order of 100 V.

Above, just the solution of principle of the invention has been described, and it is obvious to a person skilled in the art that numerous modifications can be made to said solution within the scope of the inventive idea described in the accompanying patent claims.

We claim:

1. A method for inhibition of growth of organisms on faces of constructions (11, 111) submerged in a liquid, in which method an electrically conductive structure (11) to be protected is connected as the cathode of a source (14) of direct current, or an electrically non-conductive structure (111) to be protected is first coated with an electrically conductive material **(111*a*) and connected as the cathode of a source of direct current (14), respectively, and, as the anode (12), an anode is used that has been isolated from the structure (11,111) to be protected or that is placed separate from said structure, which anode is connected as the anode of the source (14) of direct current, characterized in that a control signal is given to the source (14) of direct current from a control unit (15), which control signal changes the current density and/or the voltage supplied by the source (14) of direct current, whereby the pH of the liquid on the face of the structure (11,111) to be protected varies with such a frequency that the microbial organisms on the face of the structure (11,111)** to be protected cannot adapt themselves to the changing conditions.

2. A method as claimed in claim 1, characterized in that the current density and/or the voltage is/are changed regularly at certain time intervals.

3. A method as claimed in claim 2, characterized in that the time interval of the change in current density and/or voltage is in the range of 1 second to several days.

4. A method as claimed in claim 3, characterized in that the time interval of the change in current density and/or voltage is in the range of 1 second to 24 hours.

5. A method as claimed in claim 1, characterized in that the current density and/or the voltage is/are changed randomly.

6. A method as claimed in claim 1, characterized in that, when the current density and/or voltage is/are increased, the cathode reaction becomes more intensive, as a result of which the pH of the liquid becomes higher and the oxygen content becomes lower.

7. A method as claimed in claim 1, characterized in that the electrically conductive structure (11) is coated with a porous paint while the porosity is such that the ions necessary for closing the current circuit can pass through the porous paint to such an extent that a cathode reaction takes place.

8. A method as claimed in claim 1, characterized in that the electrically non-conductive structure (111) to be protected is coated with a paint **(111*a*)** that operates as the cathode.

9. A method as claimed in claim 1, characterized in that the supply of current to the structure (11,111) to be protected is controlled by means of a separate reference electrode (13) isolated from the structure (11,111) to be protected, which reference electrode prevents an excessive current supply to the structure (11,111) to be protected by monitoring its electrochemical potential.

10. A method as claimed in claim 1, characterized in that any organisms that may be present on the face of the structure (11,111) to be protected is monitored by means of a bio-organism detector (16), which gives a signal to the control unit (15).

11. A method as claimed in claim 1, characterized in that, as the maximum value of current density, in a seawater application, a current density of an order of 2.5 A per sq.m is used, and/or a voltage of an order of 1 V to 100 V is used as the maximal value of the voltage.

12. A method as claimed in claim 1, characterized in that, in industrial processes, as the maximal value of current density, a current density of an order of 10 A per sq. m is used, and/or a voltage of an order of 100 V is used as the maximal value of the voltage.

13. A method of inhibiting the growth of organisms on a surface of a structure submerged in a liquid, said method comprising the steps of:

(a) connecting said structure to a source of direct current, so that said structure becomes a cathode;

(b) connecting an anode to said source of direct current, said anode not being in physical contact with said structure;

(c) controlling said source of said direct current so that said current changes in density or voltage, whereby the pH of said liquid on said surface of said structure varies.

14. The method as claimed in claim 13, further comprising the step of coating said structure with an electrically conductive material.

* * * * *